United States Patent [19]

Terry

[11] 4,117,591

[45] Oct. 3, 1978

[54] NAIL CLIPPER WITH TRIM RETAINING CLAMP

[76] Inventor: Catherine S. Terry, 1 Falmouth Rd., Chatham Township, Morris County, N.J. 07928

[21] Appl. No.: 770,703

[22] Filed: Feb. 22, 1977

[51] Int. Cl.[2] ..... B26B 17/02

[52] U.S. Cl. ..... 30/124; 30/28

[58] Field of Search ..... 30/28, 124, 134, 135

[56] References Cited

U.S. PATENT DOCUMENTS

| | | | |
|---|---|---|---|
| 2,938,266 | 5/1960 | Klein | 30/124 |
| 3,310,872 | 3/1967 | Dowdell | 30/124 X |
| 3,352,010 | 11/1967 | Keller | 30/135 |

*Primary Examiner*—Jimmy C. Peters
*Attorney, Agent, or Firm*—Martha G. Pugh

[57] ABSTRACT

An improved nail clipping implement of the type comprising dual cutting-edge equipped spring arms incorporating a fold-away, pressure actuated lever mechanism for cooperatively operating the cutting edges. The improvement features a nail retaining clamping device simultaneously actuated by the lever mechanism to secure a nail trimming in position for the duration of the cutting operation, whereupon the trimming is subsequently and suitably disposed.

5 Claims, 7 Drawing Figures

NAIL CLIPPER WITH TRIM RETAINING CLAMP

BACKGROUND OF THE INVENTION

This invention relates generally to cutting instruments designed for manicuring nails and, moe specifically, to nail clippers composed of resilient, pressure-operated cutting arms and an interposed nail trimming clamping mechanism which grasps the nail trimming during the clipping process.

Two broad classes of prior art nail clipping devices are currently in use. One such clipping device is the conventional, widely-marketed type comprising a pair of cutting-edge equipped spring arms designed fo finger-tip pressure operation. This type is compact, easy to use and simple to manufacture; however, a severe shortcoming of the implement is the fact that as a nail is clipped, the trimming is propelled in a haphazard, random fashion in the immediate vicinity of the user, eventually settling, for example, on the floor, carpet or user's clothing, thus creating an unsightly appearance, a difficult disposal problem and possible unsantiary conditions.

The second such category of clipping device was designed with the primary intention of eliminating the above major shortcoming. This second type typically employs a basic structure similar to the first type and additionally includes an interposed container or receptacle for the nail trimmings. The receptacle device is constructed either as an integral part of the overall assembly, such as, for example, spring arms incorporating telescoping side flanges, or designed to be snapped or pressed into place between the inner surfaces of the spring arms. In any case, it has been determined that such receptacle devices are not completely effective in capturing and collecting all nail trimmings, particularly a trimming that is laterally propelled away from the cutting edges. Also, the sides of the receptacle may interfere with the proper positioning of the clipping device on user nails that are wider than the receptacle device and thus preclude collection of these nails within the receptacle. Moreover, it is sometimes tedious to dislodge and dispel nail trimmings collected and contained in the receptacle. In addition, the resulting nail clipper is bulky and the increased size reduces the desirability of the clipper as an accompanying accessory. Furthermore, manufacturing costs are increased due to either substantial modification of the clipper structure, or the need for additional types of materials or more manufacturing steps.

SUMMARY OF THE INVENTION

Accordingly it is an object of the present invention to build a nail clipper that is completely effective in retaining nail trimmings during the clipping operation.

Another object of this invention is to construct a nail clipper that readily and conveniently dispels the retained nail trimmings.

It is a further object of this invention to build a simple, reliable, compact nail clipping device having a neat overall appearance.

Yet another object of this invention is to manufacture an effective nail retaining clipper requiring few piece-parts and available at low cost to induce widespread use.

These and other objects are realized in accordance with the present invention of an improved nail clipping device of the type comprising conventional pressure-operated, cutting-edge equipped arms wherein the improvement includes an interposed mechanism operating in conjunction with the arms that clamps a nail trimming before, during and after cutting, whereupon the trimming is subsequently suitably discarded by releasing the pressure and shaking the trimming free.

Broadly construed, the conventional nail clipping device into which the improvement is incorporated includes a dual set of coextensive, cutting-edge equipped spring arms actuated by a lever mechanism that exerts forces on the spring arms to operatively engage the cutting edges. The preferred conventional nail clipping device comprises:

firstly, a pair of elongated, substantially similar arms made from a requisite resilient material. The arms are superimposed and fixedly joined at one of their ends; and the other end of each arm is formed so that in the unoperated mode the arms diverge from the fixed joint and are spaced-apart due to the bias of the resilient material. The free end of each arm has a sharpened edge to cuttingly engage the opposing sharpened edge of the other arm; and, secondly, a lever mechanism comprising a pin and a lever. The dowel-like pin extends through aligned holes in the free ends of the spring arms and is held in position by an enlarged head on one end of the pin and the lever at the other end of the pin. The lever is pivotally joined to the pin; and the lever has a cam that contacts one spring arm to form a fulcrum for lever action. Operation of the lever provides a force to cooperatively engage the cutting edges of the spring arms to effect nail clipping.

In combination with the conventional nail clipper described in the foregoing paragraphs, the improvement includes an interposed nail clamping mechanism that is, generally speaking, a suitably constructed and arranged device that grips the tip of the nail to be clipped prior to actual cutting with sufficient holding force to retain the nail trimming during and subsequent to the actual clipping operation. The preferred embodiment of the invention includes the preferred conventional nail clipper, designated the housing, and the preferred clamping mechanism, designated the insert, which comprises a pair of similar, flexible, elongated, thin V-shaped blades placed one atop the other and disposed near one of their ends to form a fixed juncture. The other end of each blade, proximal to the nail to be trimmed, is formed so that in the unoperated mode the blades are spaced-apart due to the flexibility of the blade material. The free end of each blade is designed to mate with the other blade to clamp the tip of the nail in tweezers-like fashion. The aforementioned blades of the insert are positioned between the spring arms of the housing, each blade of the insert having an opening for straddling the pin of the preferred lever mechanism of the housing. Each vertex of the V-shaped blade of the insert is in slidable contact relation with the corresponding spring arms of the housing so that as the lever of the housing operates the spring arms of the housing, a force is simultaneously transmitted and applied to the vertices of the insert, this force acting to register the clamp ends of the blades. The blades of the insert are of commensurate length to grip the tip of the nail as the nail is positioned for clipping. The preferred nail clipping implement is designed so that not only do the clamp ends of the insert engage the nail before the cutting edges of the housing register, but also the rate at which the clamp ends of the insert approach the nail is always greater than the rate at which the cutting edges of the housing approach the nail. This relation between the rates insures that an appropriate holding force is generated and maintained at the clamp ends of the insert.

In an alternative embodiment of the present invention, nail clamping is achieved by a pair of cooperatively engaging blocks that are fastened near the sharpened ends of the spring arms, one under each arm, at a location and separation commensurate with the clamping position of a nail inserted for trimming. The blocks are usually made from a flexible, spongy material, such as rubber, and overhang the cutting edges so that upon application of the actuating pressure, the blocks grasp the nail before the cutting edges contact the nail.

A particularly novel feature of the nail clipping device constructed in accordance with the present invention is that the nail to be trimmed is held immobile by a holding force that is increasingly applied as the cutting operation proceeds, thereby precluding the possibility of unwanted ejection or premature loss of the nail trimming before suitable disposal is arranged.

These and other objects, features and advantages will be apparent hereinafter from a detailed disclosure of the invention relative to the attached drawings.

BRIEF DESCRIPTIONS OF THE DRAWINGS

DETAILED DESCRIPTION

Figure 1:
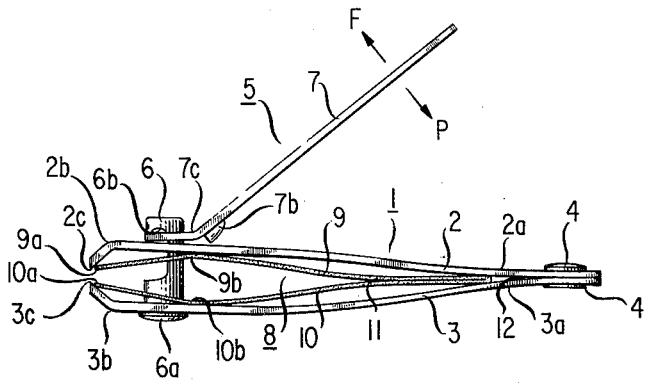
FIG. 1 is a view in longitudinal side elevation of the preferred embodiment of the present invention in its open position, ready for use.
Figure 2:
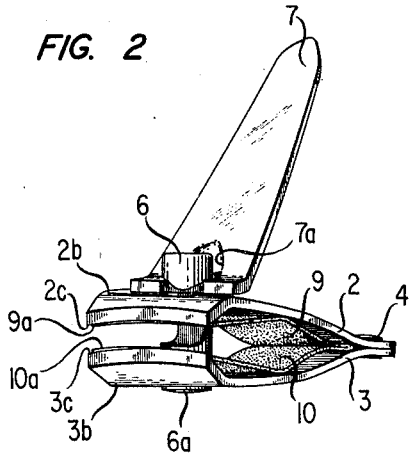
FIG. 2 is a frontal perspective view of the preferred embodiment of the nail clipper shown in FIG. 1 in the open position, ready for use.

As pointed out in the introduction of this specification, the present invention relates to a nail clipping device having a trim retaining clamp. A specific example described herein by way of illustration comprises the nail clipper shown opened and ready for use in the longitudinal side elevation view of FIG. 1 and in the frontal perspective view in FIG. 2. With reference to FIG. 1, the overall clipper implement is generally characterized by three component parts, namely: spring arm assembly 1 comprising a pair of juxtaposed cutting edges; associated lever mechanism 5 for applying pressure; and interposed clamping mechanism 8. The structure as well as operation of the clipper device depicted in FIG. 1 will be set forth in the following detailed description.

The arm assembly 1 is composed of upper spring arm 2 and companion lower spring arm 3 both similarly designed and constructed from substantially the same resilient material. The term resilient used herein denotes the elastic property of a material to return to its original shape or dimensions after undergoing strain due to applied stress. The modulus of elasticity serves as a useful measure of the resiliency of a material. The modulus is defined as the constant ratio between stress and strain below the proportional limit, this limit being indicative of the maximum stress that can be developed in a material without causing permanent deformation. In the preferred embodiment of the clipper of FIG. 1, the spring arm 2 and 3 are typically made from surface finished, non-corrodible stainless steel having a modulus of elasticity of about 29 million pounds per square inch. Near the right terminal ends of arms 2 and 3 are respectively disposed an upward bend 2*a* and downward bend 3*a* that cooperate to form diverging cantilevers of the arms 2 and 3 when bends 2*a* and 3*a*, are are superimposed in back-to-back relation. In this position, the right ends of arms 2 and 3 are fixedly jointed, such as, for example, by a fastener 4, typically a rivot, that is situated in adjacent aligned holes. A welded or brazed connection or a combination of rivoting and welding or brazing can also be substituted to form an acceptable joint. Due to the rigid interconnection of arms 2 and 3 by fastener 4, a relatively fixed pivot 12 is formed at the junction of arms 2 and 3. The left end of arm 2 is curved downwardly as at 2*b* to form a lateral lip 2*c*, which is sharpened at its tip and suitably arced to conform to the curvature of the tip of a finger or toe. Similarly, the left end of arm 3 has an upwardly curved characteristic, shown as 3*b*, to form a lateral lip 3*c*, which is also appropriately sharpened and arced. The cutting edges of lips 2*c* and 3*c* are vertically aligned to cooperatively engage and slice through a nail positioned for clipping.

Due to the diverging manner in which arms 2 and 3 are joined, as well as the natural resiliency of the material forming arms 2 and 3, lips 2*c* and 3*c* are normally spaced-apart at a distance significantly greater than the thickness of a nail. Sufficient force to drive the cutting lips 2*c* and 3*c* together for clipping action is provided by lever mechanism 5, which is comprised of pin 6 and lever 7, both made from a material substantially similar to that used for spring arm assembly 1. Pin 6 is typically a rotatable, dowel-like rod having an enlarged head 6*a* on one end that seats on the under side of arm 3. Pin 6 projects up and through correspondingly aligned holes near the free ends of arms 2 and 3, terminating above the top side of arm 2. Formed at the end of pin 6 opposite head 6*a* is hook 6*b* to which a loop 7*a* (see FIG. 2) on one end of lever 7 is pivotally engaged. As shown in FIG. 1, head 6*a* and lever 7 cooperate to hold pin 6 in position. Lever 7 has a cam protrusion 7*b* that contacts the upper side of arm 2 in a slidable relation to form a fulcrum for transferring force from lever 7 to arms 2 and 3. Pressure exerted in the direction of arrow P between the end of lever 7 and the fixed pivot 12 formed by fastener 4 at the right ends of arms 2 and 3, such as by finger-tip action, is transmitted downwardly to arm 2 by cam 7*b* and upwardly to arm 3 by head 6*a* acting through pin 6 which serves as a force transmitting member.

Figure 3:
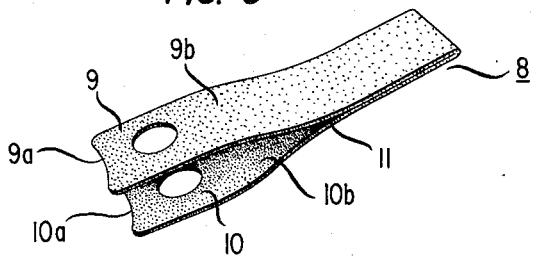
FIG. 3 is a frontal perspective view of the preferred embodiment of the clamping mechanism shown removed from the nail clipping assembly of FIG. 1.

Operating in direct response to the same pressure P as applied to arms 2 and 3 is the nail clamping mechanism 8, shown in perspective view in FIG. 3, comprising juncture 11 and elements 9 and 10, which are similar, elongated, thin blades made from a resilient material substantially the same as that used for the spring arm assembly 1 or lever assembly 5. For the usual case in which blades 9 and 10 are built from a unitary piece of material, the fixed juncture 11 is formed near the right terminal ends of blades 9 and 10, as referenced to FIG. 1, by folding back the pieces in overlay relation so that the free ends of the piece are flush and then compressing treating the fold. In an alternative case, in which blades 9 and 10 are built from separate pieces of material, the fixed juncture 11 is formed by fastening together the right end portions of blades 9 and 10, such as by welding or brazing. In any case, the free ends of blades 9 and 10 are disposed to diverge from juncture 11 and are spaced-apart due to the bias of the resilient material used for blades 9 and 10. As shown in FIG. 3, the free end of blade 9 is arcuately curved, in a manner similar to the curve of lip 2c of FIG. 2, to form a laterally projecting jaw 9a conforming at its external edge to the contour of the tip of a finger or toe. The jaw 10a in FIG. 3 is similarly formed at the free end of blade 10 and has substantially the same shape as jaw 9a but is disposed in reverse relation to jaw 9a. Jaws 9a and 10a are vertically aligned to cooperatively approach and then clamp the tip of a nail inserted for trimming whenever proper pressure is applied to the clipper implement. Blades 9 and 10 also have shaped vertices 9b and 10b, respectively, that are force receiving members suitably located between juncture 11 and jaws 9a and 10a in a manner to be discussed shortly when the geometrical representation of the implement is presented.

Figure 4:
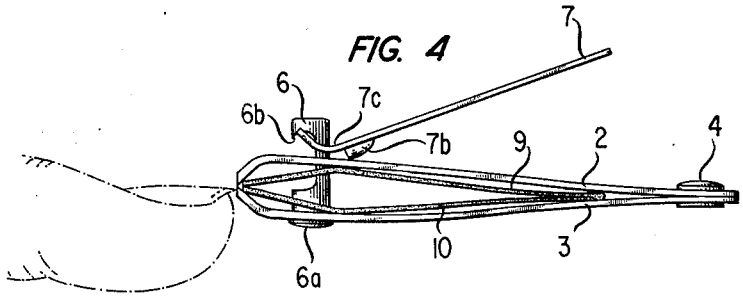
FIG. 4 is a view in longitudinal side elevation of the embodiment shown in FIG. 1 depicting the clipping device positioned and in cutting relation to the nail of the user.

Referring to FIG. 1, clamping mechanism 8 is positioned by wedging juncture 11 in place between the converging ends of arms 2 and 3, and is held in position by aligned holes in blades 9 and 10 that straddle pin 6. The overall shape of the clamping mechanism 8 conforms to the design of the spring arm assembly 1 in that the transverse width of elements 9 and 10 is usually not greater than the transverse width of arms 2 and 3 so mechanism 8 does not protrude beyond the sides of assembly 1. The operation of arms 2 and 3 transmits force to vertices 9b and 10b, which are in slidable contact relation with the inner surfaces of arms 2 and 3, and this force serves to constrict jaws 9a and 10a. The acute inner angle of each vertex 9b or 10b is initially but temporarily controlled by the angle between diverging arms 2 and 3. The angle of each vertex is maintained essentially constant during initial constriction of blades 9 and 10. Ultimately, however, jaws 9a and 10a both contact the inserted nail, whereupon each inner vertex angle increases, thereby stressing the resilient material and generating additional holding force on the gripped nail. The enlarged angle of each vertex 9b, 10b is observed with reference to FIG. 4, which shows a view in longitudinal side elevation of the clipper positioned and in cutting relation to the nail of the user.

Figure 5:
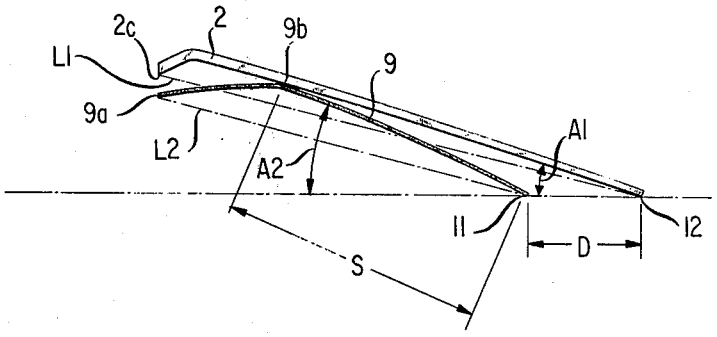
FIG. 5 is a geometrical representation of the top portion of the nail clipper of FIG. 1, indicating specific distances and angles for rate calculations.

A particularly important feature of the clipper is the geometrical relationship between the spring arms 2 and 3 and the blades 9 and 10. As pressure is applied to operate the implement, it is evident that arms 2 and 3 and the blades 9 and 10 approach the nail to be clipped, but in a dynamically changing relationship. A geometrical representation of the upper half of the clipper shown in FIG. 1 is given in FIG. 5, which depicts specific angles and lengths that are now used to quantify the dynamic behavior of the clipper. A study of the geometry of the upper half of the clipper is sufficiently indicative of the overall behavior because of the basic symmetry of the device.

Angle A1 is the angle between the inner surface of upper arm 2 and the longitudinal axis of symmetry of the device represented by a line connecting juncture 11 and pivot 12. Angle A2 is the angle between the inner surface of blade 9 and the longitudinal axis of symmetry. The length D is the distance measured along a straight line between juncture 11 and pivot 12. Length S is the distance between juncture 11 and the point at which vertex 9b contacts the under side of arm 2 as measured along the inner surface of blade 9. Length L1 is the straight line distance between the tip of lip 2c and pivot 12, as shown by the dashed line. Length L2 is the straight line distance between the tip of jaw 9a and juncture 11, as shown by the dashed lne. A constraint on a practical clipper design is that, when L1 and L2 both lie on the longitudinal axis of symmetry, L2 plus D must be less than or equal L1, and in fact, L2 plus D is chosen to be essentially equal to L1 for proper and efficient operation. Then, the angle A2 is related to the angle A1 for the above equality constraint through the relation:

$$A2 = A1 + \sin^{-1}[(D/S)\sin(A1)]. \quad (1)$$

With the constraint on the sum of L2 and D equalling L1 and thus equation 1 being true, it can be shown using standard differential calculus techniques that as the lever mechanism 5 is forcing the upper arm 2 to bend about pivot 12 and blade 9 to bend about juncture 11, but before blades 9 and 10 contact the nail, the ratio of the rate of change of angle A1 relative to the rate of change of angle A2, this ratio designated R, is given by:

$$R = 1 + \frac{(D/S)\cos(A1)}{\sqrt{1 - (D/S)^2\sin^2(A1)}}. \quad (2)$$

From equation (2) it is deduced that for normal design geometries, such as, for example, angle A1 and angle A2 both less than 45° and the length S greater than the length D, that R is always positive, which implies that blades 9 and 10 always close at a rate faster than the rate at which arms 2 and 3 close. This geometrical relation is exploited to guarantee that sufficient holding force is generated and increasingly maintained during the clipping operation.

Figure 6:
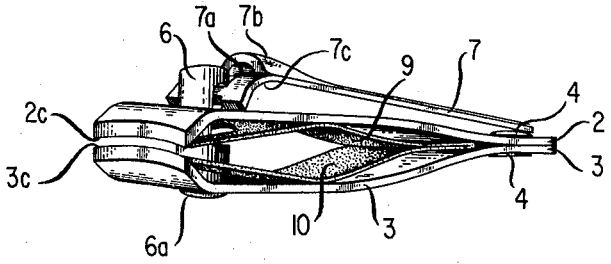
FIG. 6 is a frontal perspective showing of the preferred embodiment of the nail clipping device of FIG. 1 depicted in its closed position, ready for storage.

To complete the discussion of the illustrative embodiment, FIG. 6 shows the clipper closed and ready for storage. To achieve the closed position, a force in the direction of arrow F in FIG. 1 is exerted on lever 7, which can then be collapsed and placed in the folded position because of the hinged connection of lever 7 with rotatable pin 6. Lever 7 is shorter than the overall length of spring arms 2 and 3 so that a compact storage position is obtained. Bend 7c and loop 7a are suitably constructed and arranged with hook 6b to advantageously use the natural resiliency of spring arms 2 and 3 to fixedly hold lever 7 in the closed position depicted in FIG. 6 and thus preclude lever 7 from swinging to an unwanted, partially open position.

Figure 7:
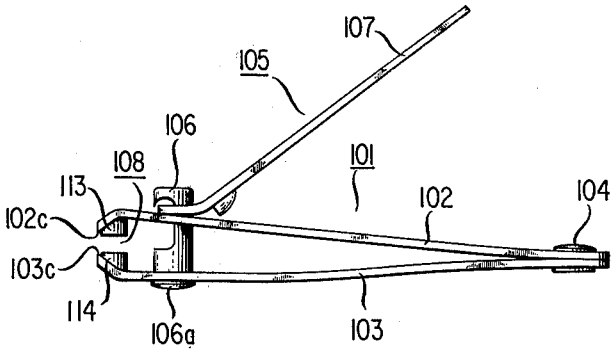
FIG. 7 is a view in longitudinal side elevation showing an alternative embodiment of the present invention including nail clamping blocks which are shown in place behind the cutting edges.

A possible alternative embodiment of a nail clipping device constructed in accordance with the present invention is shown in the longitudinal side elevation view of FIG. 7. Two of the three component parts previously described, namely, the spring assembly 1 and the lever mechanism 5, remain essentially unaltered in the alternative embodiment and are designated 101 and 105, respectively. However, the interposed clamping mechanism, previously designated 8 but now designated 108 in FIG. 7, comprises similarly designed blocks 113 and 114 made from substantially the same flexible, spongy material, usually rubber, mounted in overhang relation on the inner surfaces of arms 102 and 103 and disposed to cooperatively engage and clamp a nail positioned for trimming. In this design, the rate at which the blocks approach the nail is the same as the rate at which the arms approach the nail. The holding force is now controlled mainly by the friction and compression characteristics of the block material. Elements in FIG. 7 having number designations to which 100 have been added correspond to similar elements in FIG. 1. For example, 102 in FIG. 7 corresponds to element 2 in FIG. 1.

It will be further understood that the nail clipping device herein described is not limited to specific forms disclosed by way of example and illustration, but may assume other forms, materials or dimensions limited only by the scope of the appended claims.

What is claimed is:

1. In combination with a nail clipping device having a dual set of elongated spring arms of a first resilient material, said spring arms constructed and arranged in superimposed relation with one of their ends fixedly joined together to form a fixed juncture including an arm cantilever point, the free ends of said spring arms opposite said fixed juncture disposed to diverge from said arm cantilever point and be normally spaced-apart due to the resiliency of said first material, said free ends having transversely extending, inwardly directed lips with cutting edges constructed to project together in cooperative cutting relation, a pin extending through aligned holes disposed near said free ends, a lever pivotally attached to said pin, said pin held in place by a seat on one end and by said lever at the other end, said lever having a cam contacting one of said arms for moving said lips towards each other in cutting relation to a portion of an interjected nail of a user:

means for clamping said nail portion, said clamping means formed from a pair of superposed, elongated blades of a second resilient material and disposed between said spring arms, each said blade having an opening constructed to straddle said pin, said blades fastened together at one of their ends to form a fixed juncture including a blade cantilever point, said blades disposed to diverge from said blade cantilever point towards said free ends of said spring arms, said blades having their forward ends normally spaced-apart by the spring action of said second resilient material, said forward ends of said blades being bent towards one another from oppositely directed vertices, said blades constrained by contact of said vertices with the inner surfaces of said spring arms, said free ends of said blades projecting laterally to define jaws constructed to cooperatively engage the interjected nail of the user prior to and during cutting in response to operation of said lever to close said blades, and said blades responsive to a reduction of pressure exerted on said lever to release said nail trimming for proper discarding.

2. A combination as recited in claim 1 wherein said first and said second resilient materials have a modulus of elasticity of at least about 29 million pounds per square inch.

3. A combination as recited in claim 2 wherein said second resilient material has a modulus of elasticity substantially greater than the modulus of elasticity of said first resilient material.

4. A combination as recited in claim 1 wherein:

length D is the straight line distance between said arm cantilever point and said blade cantilever point;

length L1 is the straight line distance between said arm cantilever point and said cutting edge on said upper lip of one said spring arm;

length L2 is the straight line distance between said blade cantilever point and said upper jaw of one said blade;

in said combination L1 being at least as great as L2 plus D.

5. The combination as recited in claim 4 wherein:

length S is the straight line distance between said blade cantilever point and the point of contact of said upper vertex of one said blade with said inner surface of said upper spring arm;

angle A1 is the acute angle between said inner surface of said upper spring arm and the straight line joining said arm cantilever point with said blade cantilever point;

angle A2 is the acute angle between the inner surface of said blade that joins said blade cantilever point with said upper vertex of one said blade and the straight line joining said arm cantilever point with said blade cantilever point;

and, in said combination, L2 plus D being substantially equal to L1, so that the relation between A1 and A2 is given by:

$$A2 = A1 + \sin^{-1}[(D/S)\sin(A1)];$$

and the ratio between the rate of change of angle A1 relative to the rate of change of angle A2 is given approximately by:

$$1 + \frac{(D/S)\cos(A1)}{\sqrt{1 - (D/S)^2\sin^2(A1)}}.$$

* * * * *